US006467660B2

(12) United States Patent
Rogers et al.

(10) Patent No.: US 6,467,660 B2
(45) Date of Patent: Oct. 22, 2002

(54) AUTOMATIC LOCKING HOLSTER

(75) Inventors: William H. Rogers; Norman E. Clifton, Jr., both of Jacksonville, FL (US)

(73) Assignee: Safariland Ltd., Inc., Ontario, CA (US)

( * ) Notice: Subject to any disclaimer, the term of this patent is extended or adjusted under 35 U.S.C. 154(b) by 0 days.

(21) Appl. No.: 09/770,710

(22) Filed: Jan. 26, 2001

(65) Prior Publication Data

US 2002/0100779 A1 Aug. 1, 2002

(51) Int. Cl.[7] ..... F41C 33/02
(52) U.S. Cl. ..... 224/243; 224/238; 224/912
(58) Field of Search ..... 224/193, 243, 224/244, 238, 911, 912

(56) References Cited

U.S. PATENT DOCUMENTS 3,420,420 A * 1/1969 Clark ..... 224/243
5,094,376 A * 3/1992 Baruch ..... 224/193
5,944,239 A * 8/1999 Rogers et al. ..... 224/193
6,085,951 A * 7/2000 Beletsky et al. ..... 224/242
6,267,279 B1 * 7/2001 Matthews ..... 224/191

* cited by examiner

*Primary Examiner*—Stephen K. Cronin
(74) *Attorney, Agent, or Firm*—Arthur G. Yeager

(57) ABSTRACT

A holster includes a quick release withdrawal restraint and is constructed of an inner and outer sidewall joined together along a front and back to define an inner cavity with an open top shaped to fit a handgun. The quick restraint includes a mechanical stop located in the inner cavity to engage a portion of the handgun adjacent the ejection port to inhibit withdrawal upwardly prior to rearward movement of the handgun. A mechanical blocking element is also provided adjacent the rear of the trigger guard that is biased into a first position to prevent rearward movement of the gun and a second position that allows for rearward movement of a gun when the blocking element is moved by pressure on a thumb or finger ledge.

31 Claims, 5 Drawing Sheets

AUTOMATIC LOCKING HOLSTER

CROSS REFERENCE TO RELATED APPLICATIONS

This application is related to an application entitled "RELEASABLE BLOCK FOR ROTATING HOOD HOLSTER" Ser. No. 09/562,085, filed by Norman Clifton on Apr. 27, 2000; and an application entitled "SUPPORT PLATE FOR A HOLSTER", Ser. No. 09/696,561, filed by William Rogers and Norman Clifton on Oct. 25, 2000.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

This invention generally relates to handgun holsters and more particularly a holster with improved features to prevent inadvertent dislodgement or withdrawal of the handgun from the holster. The holster is designed to retain the handgun securely and yet to permit rapid withdrawal when required.

2. Prior Art

Most attacks on police officers by assailants trying to remove officer's handguns from holsters have come from the front or side of officers and not from the rear. It is obvious that an assailant has more mechanical leverage as well as an unobstructed path by simply pulling forward and up on the handle of the weapon while standing in front facing the officer or facing him at his side.

Most securing straps of holsters might become unlocked in a violent attack. Because of this possibility, an internal locking method is incorporated in some of the prior art holsters to make it more difficult for the attacker to remove the handgun from the holster in an attack from the rear of the officer. Generally, the internal locking means engages the back recurve of the trigger guard or the top ledge of a cylinder of a revolver. In more recent times the popularity of the semiautomatic pistol has posed a problem in the design of a secure holster because this type of handgun has no cylinder ledges nor trigger guard recurves to serve as a locking point. An attempt to lock upon the forward portion of the trigger guard is not preferred because only a few models of semiautomatics offer a flat ledge at the forward portion of the trigger guard necessary for the locking action.

What is needed is an improved handgun holster which overcomes the deficiencies of the prior art, and is designed to provide a holster which secures the handgun from withdrawal by any but the wearer and yet permits a fast withdrawal upwardly by one trained in using the holster. Further, a holster is needed that provides obstacles to one attempting an unauthorized withdrawal of the handgun from the front or side of the holster.

In addition, a need exists for apparatus that provides a way to allow a user to rapidly reholster a gun securely and quickly if it is not needed in a particular circumstance. For example, a user may draw a gun and find that deadly force is not required and that hand-to-hand action will suffice against a criminal suspect. A user would then need to rapidly reholster the gun without looking but still have the gun secured by a fast acting, self-locking apparatus in a manner that greatly inhibits its grasp by an assailant.

BRIEF SUMMARY OF THE INVENTION

In one aspect of the present invention there is provided a holster comprising a quick release withdrawal restraint, an inner and outer sidewall joined together along front and back portions to define an inner cavity having an open top shaped to fit a handgun holstered therein, the restraint including mechanical means located in the inner cavity to engage a portion of a handgun in the holster to inhibit withdrawal of a handgun upwardly prior to rearward movement of a handgun. Blocking means includes a body member mounted adjacent the rear portion and is biased in a first position that engages a portion of a handgun to inhibit rearward movement of a handgun until the body member is selectively moved, the body member also having a second position that permits rearward movement of a handgun to withdraw same from the holster. The mechanical means includes stop means that has a removable element and means to retain the element to the holster in a fixed position. The mechanical means also includes inwardly disposed stop means having a boss with a front end portion and a rear end portion, the front end portion being shaped to engage an ejection port of a handgun to inhibit upward movement of a handgun. The rear portion of the boss is tapered to allow a muzzle of a handgun to slide therealong without contact with the stop means during insertion of a handgun into the holster until a handgun is fully seated in the holster.

The blocking means further includes attaching means for mounting the body member to the holster for movement of the body member between first and second positions. The body member includes a finger ledge for selectively moving the body member with respect to attaching the means with a force applied by a finger of a user. The body member is movable out of engagement with a trigger guard of a handgun when force is applied by a middle finger of a user to the finger ledge. The body member is movable inwardly toward a user by force applied to the finger ledge by a middle finger of a user. The body member alternately may be movable downwardly by force applied to ledge by a finger of a user. The body member includes a laterally extending flange member shielding an upper edge of the inner cavity to inhibit entry of debris into the cavity which otherwise may foul movement of the body member. Biasing means is mounted inside the cavity of the holster for forcing a handgun forwardly in the holster for engagement of a handgun with the stop means. The biasing means includes a housing affixed to the holster, the blocking means includes a body member and attaching means for mounting the body member to the housing of the biasing means. The housing includes a laterally projecting post member, the body member of the blocking means having an opening formed therein to fit the post member therein when the blocking means is in the first position to inhibit rotative movement of the body member, the post member being at least partially removed from the opening when the body member is in the second position.

In another aspect of the present invention there is provided a holster comprising a quick release withdrawal restraint, an inner and outer sidewall joined together along front and back portions to define an inner cavity having an open top shaped to fit a handgun holster therein, the restraint including mechanical stop means located in the inner cavity to engage a portion of a handgun in the holster to inhibit withdrawal of a handgun upwardly prior to rearward movement of a handgun and blocking means including a body member mounted adjacent the rear portion and biased in a first position that engages a portion of a handgun to inhibit rearward movement of a handgun until the body member is selectively moved, the body member also having a second position that permits rearward movement of a handgun to withdraw same from the holster. The stop means includes a removable element and means to retain the element to the holster in a fixed position. The stop means includes an inwardly disposed boss having a front end portion and a rear end portion, the front end portion of the boss being shaped to engage the inner surface of an ejection port of a handgun to inhibit upward movement of a handgun. The rear portion of the boss is tapered to allow a muzzle of a handgun to slide therealong without contact with the stop means during insertion of a handgun into the holster until a handgun is fully seated in the holster. The blocking means further includes attaching means for mounting the body member to the holster for movement of the body member between first and second positions. The body member includes a finger ledge for selectively moving the body member with regard to the attaching means with a force applied by the finger of a user. The body member includes a laterally extending flange member shielding an upper edge of the inner cavity to inhibit entry of debris into the cavity which otherwise may foul movement of the body member. Biasing means is mounted inside the cavity of the holster for forcing a handgun forwardly in the holster for engagement of a handgun with the stop means. The biasing means includes a housing affixed to the holster, the blocking means includes a body member and attaching means for mounting the body member to the housing of the biasing means. The housing includes a laterally projecting post member, the body member of the blocking means having an opening formed therein to fit the post member therein when the blocking means is in the first position to inhibit rotative movement of the body member, the post member being at least partially removed from the opening when the body member is in the second position.

Other aspects of the invention include an elongated restraining strap having opposite ends and a medial portion bridging the sidewalls across the open top, means for pivotal attachment of the opposite ends of the strap to respective sidewalls to permit movement of the strap from a position across the open top to restrict handgun withdrawal to a position generally forwardly of the holster to permit handgun withdrawal, the means for pivotal attachment including a detent means releasably engaged with the means for pivotal attachment for preventing forward pivotal movement of the restraining strap until the strap is moved at the means for pivotal attachment in a predetermined direction. There is also selectively operable blocking means attached to the holster movable between a first position to prevent forward pivotal movement of the strap after the strap has first been in the downward direction and a second position to allow forward pivotal movement of the strap after the strap has been moved in the downward direction.

There is also provided a holster comprising a quick release withdrawal restraint, an inner and outer sidewall joined together along front and back portions to define an inner cavity having an open top shaped to fit a handgun holstered therein, the restraint including mechanical means located in the inner cavity to engage a portion of a handgun in the holster to inhibit withdrawal of a handgun upwardly prior to rearward movement of a handgun, blocking means including a body member mounted adjacent the rear portion and biased in a first position that engages a trigger guard of a handgun to inhibit rearward movement of a handgun until the body member is selectively moved, the body member having a second position that permits rearward movement of a handgun to withdraw same from the holster and biasing means mounted inside the cavity of the holster for forcing a handgun forwardly in the holster for engagement of a handgun with the mechanical means. The biasing means includes a housing affixed to the holster, the blocking means includes a body member and attaching means for mounting the body member to said housing of the biasing means. The body member includes a finger ledge for selectively moving the body member with regard to the attaching means with a force applied by the finger of a user. The mechanical means includes stop means having an inwardly disposed boss for engagement with an ejection port of a handgun to inhibit upward movement of a handgun.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

The present invention incorporates features of previous patents and co-pending applications of one or both of the present inventions.

1. The present holster employs the biasing apparatus of Rogers, et al '239 to force a handgun forwardly to position the ejection port of a semi-automatic handgun against a stop in the holster. Once seated in this manner, the gun cannot be withdrawn in a simple vertical manner. Rather, the gun must be forced rearwardly against the biasing means to remove it from the stop means. In the present invention, the stop means has been improved to make it removable in the event it becomes worn down so that a new stop means may be inserted. In addition, the stop means is replaceable by another stop means more appropriate to the handgun being used. In the present invention, the stop means is specifically designed to work with a Glock handgun. If the holster is to be used with another type of handgun, the stop means can be easily replaced with one that provides a better match for the handgun actually being used.

2. The present invention employs the bridging strap of Rogers, et al '381. The bridging strap rides over the rear of a handgun and includes a hood that is rotatable forwardly thus allowing the gun to be withdrawn. The hood is connected to a vertically movable leg member that must be depressed downwardly to allow for rotation of the hood forwardly.

3. The present holster also includes the hood blocking means of Rogers, et al application '085. A positive locking means is positionable in a manner to prevent downward movement of the leg member unless a blocking member is rotated rearwardly out of the way. Because the blocking member must be rotated rearwardly to allow the leg member to be moved downwardly the required action makes it very difficult for an assailant to withdraw the gun. When used with the biasing element and stop means as discussed above even greater security is achieved.

4. The present holster is designed to be used with the improved holster back plate disclosed in Rogers, et al—application Ser. No. 09/696,561. The improved back plate cooperates with a holster belt to prevent movement of the holster forwardly and rearwardly along the belt. This feature includes greater assurance that the holster remains where the user sets it and provides the security of knowing precisely where the accompanying handgun is located.

5. The present holster provides for an alternative to the rear strap used in Rogers '980. The strap used therein operates to hold the rear of the holster—shaped like a clam shell—to be held tightly together providing additional security against assailant withdrawal.

Figure 1:
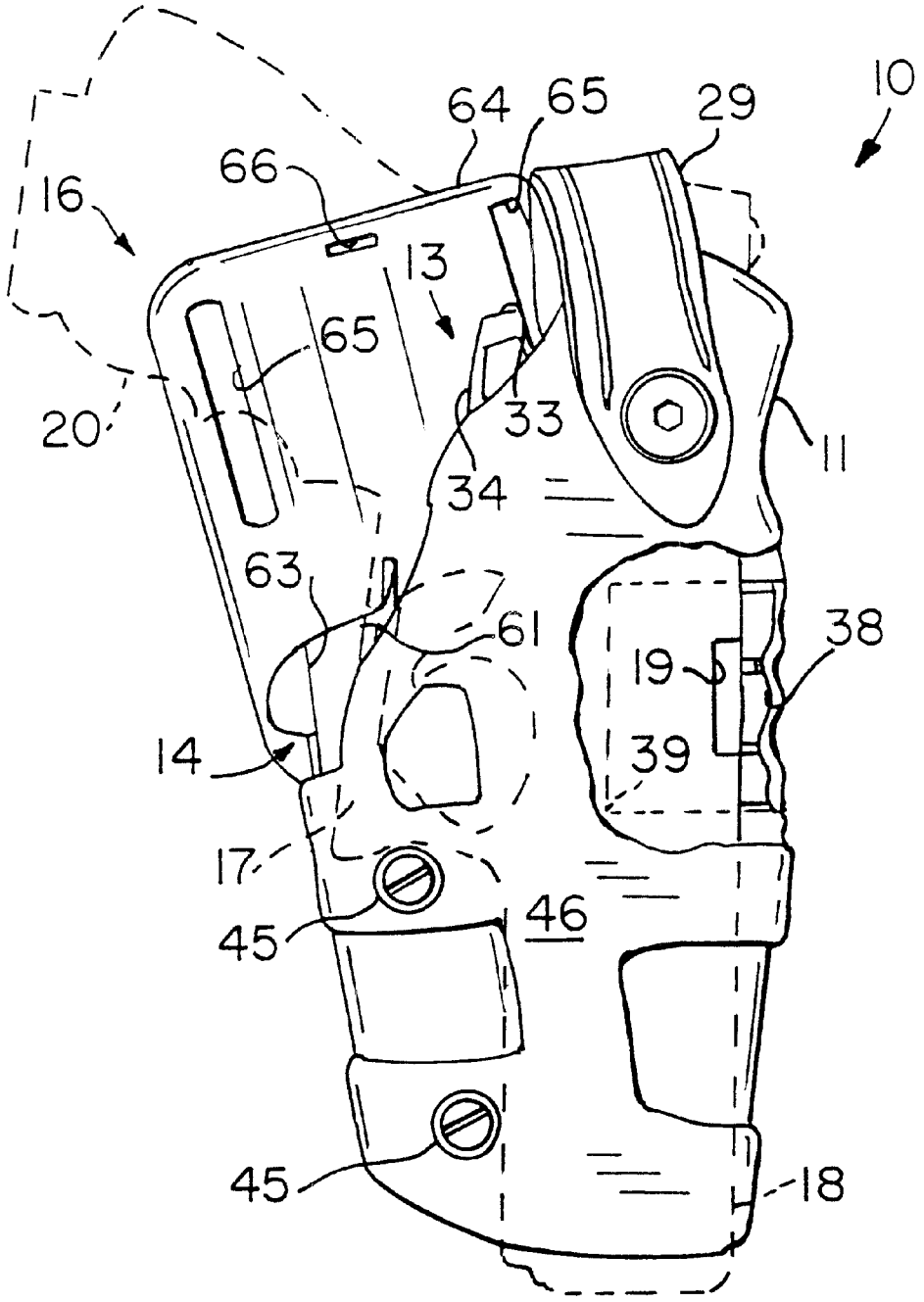
FIG. 1 is a side view of the holster according to the present invention with a portion cut away to illustrate the space used to secure stop means to the holster.
Figure 2:
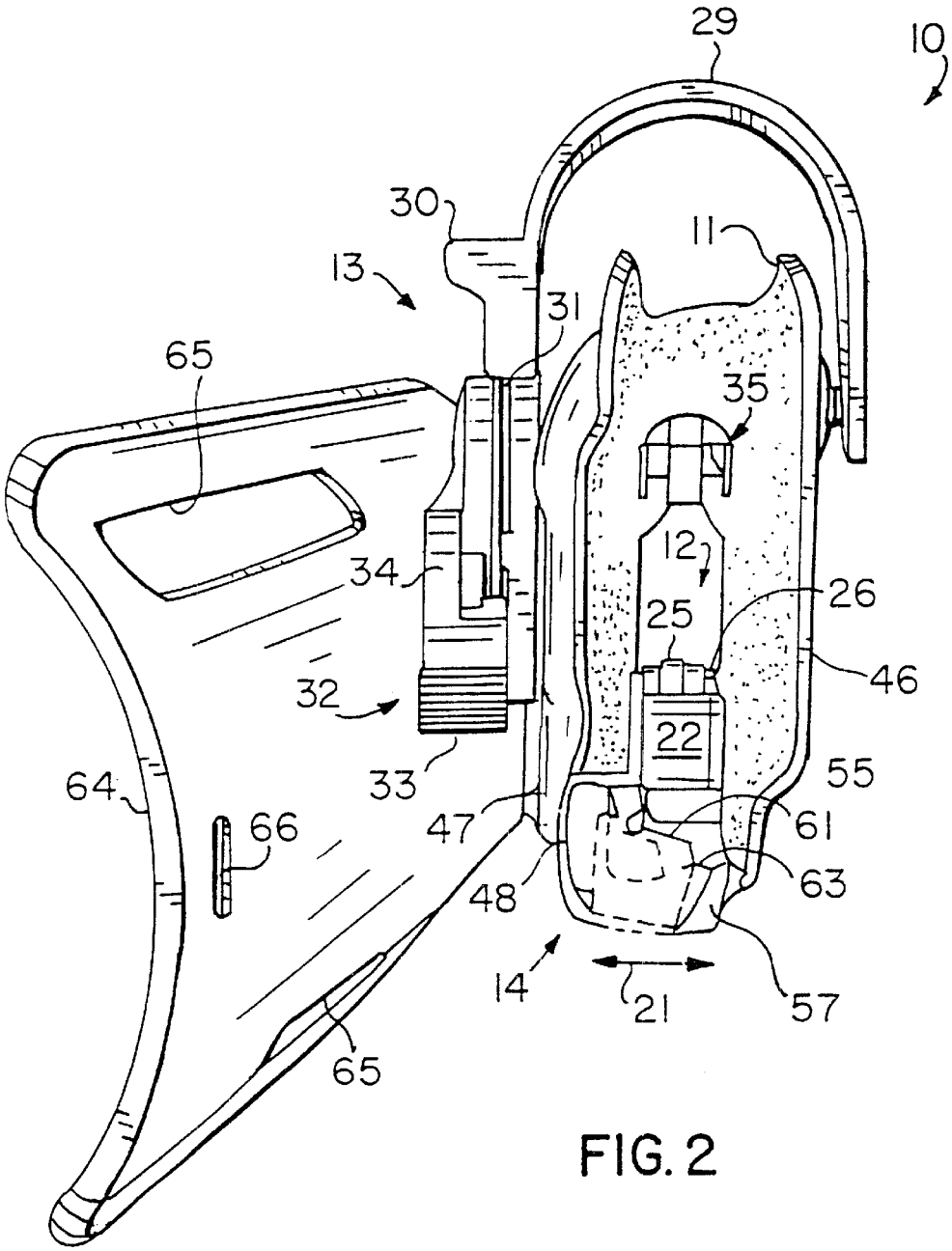
FIG. 2 is a top view of the holster of FIG. 1.

With reference now to the drawings, FIGS. 1 and 2 illustrate at numeral 10 a side view and rear view respectively of the holster 11 in accordance with the present invention. Biasing apparatus 12 forces a handgun 16 (shown in dotted line in FIG. 1) forwardly against stop means 15 (shown only generally in FIG. 2).

Hood strap assembly 13 is shown up in FIG. 1 and rotated forwardly in FIG. 2. The rearward securing assembly is shown generally at 14 and is movable inwardly. (in broken line) from its normal position (shown in solid line) as indicated by arrow 21.

Figure 3:
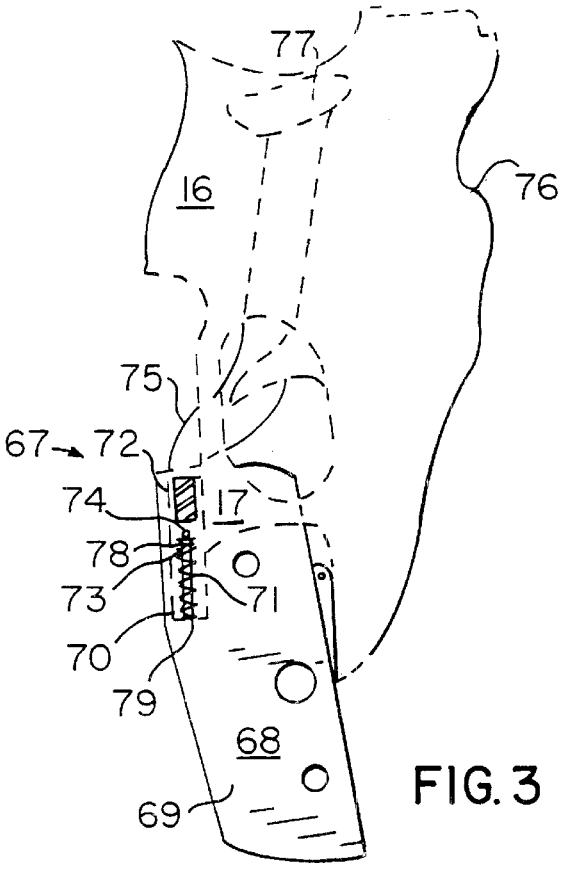
FIG. 3 is a perspective of an alternate embodiment of the rearward securing assembly of FIG. 1.

With reference to FIGS. 1 and 3, forward biasing means 12 includes a support body 22 by which the apparatus 12 is attached to holster 11. An engaging member 23 is pivotally mounted via pin 24. Member 23 carries a roller 25 mounted on axle 26 and is internally spring biased to be forced against trigger guard 17. Flange 27 provides for mounting body 22 to holster 11 via a T-nut 28 or other appropriate means as illustrated in U.S. Pat. No. 5,944,239 incorporated herein by reference. With respect again to FIG. 2, hood strap assembly 13 includes hood strap 29 having a thumb ledge 30 by which leg 31 can be pushed downwardly to allow for strap 29 to be rotated forwardly as shown once the locking mechanism is cleared as clearly illustrated in U.S. Pat. No. 5,501,381 which is herein incorporated by reference.

Releasable blocking apparatus 32 includes a thumb ledge 33 by which a blocking element 34 can be moved rearwardly to allow leg 31 to be pushed downwardly as clearly illustrated in application Ser. No. 09/562,085 which is herein incorporated by reference.

Figure 4:
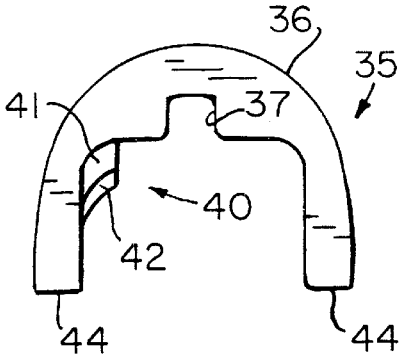
FIG. 4 is a cross-section of the stop means used in the holster.
Figure 5:
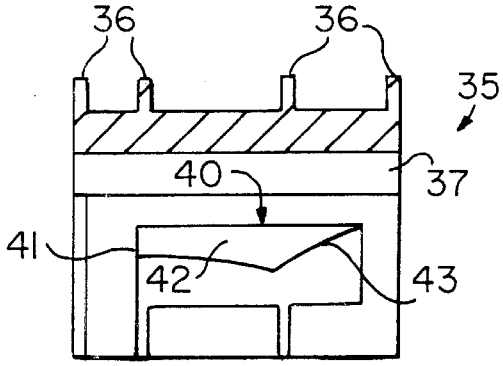
FIG. 5 is a front elevational view of the stop means of FIG. 4.

FIGS. 4 and 5 illustrate the preferred stop means used in the present invention. Stop means insert 35 includes a series of ribs 36 that match curved interior channel 38 in holster 11 resting on ledges 39 (FIG. 2) which fixes it in place when the holster is closed with screws 45. Interior upper channel 37 provides clearance for the forward sight 18 of a handgun 16. Boss 40 includes three portions: a first flat portion 41 fits into the forward portion of an ejection port 19; and second and third portions 42 and 43 that "cam up" or guide the muzzle of a handgun 16 when it is inserted into the holster 11. Biasing apparatus 12 also engages the gun, forcing it upwardly against the forward portion of the holster 11 providing that boss 40 fits into port 19. Direct rearward (i.e., vertical) movement of the handgun 16 will be blocked by the forward part of the gun 16 adjacent the forward edge of port 19 coming into contact with front portion 41 of boss 40. Accordingly, rearward motion of the gun 16 against biasing apparatus 12 is required to clear boss 40 and remove the gun 16 from holster 11.

Stop means 35 is a unitary plastic element that fits into interior space 38 and is secured into position when screws 45 are tightened to close the holster 11 without any additional mechanical means and is therefore easily replaceable. The holster 11 is held together rearwardly in a clamshell-like fashion via screws 45 that provide for sufficient closure of the holster side 46 and the two inward overlapping sidewall portions 47 and 48. Portion 47 is unitary with side 46 and is formed to overlie portion 48 to further provide for security against gun 16 being withdrawn by an assailant a rearward engaging means 14 is employed to prevent rearward movement of the gun 16 unless a blocking element 49 is pushed inwardly and out of the way of the trigger guard 17 by a user.

Figure 6:
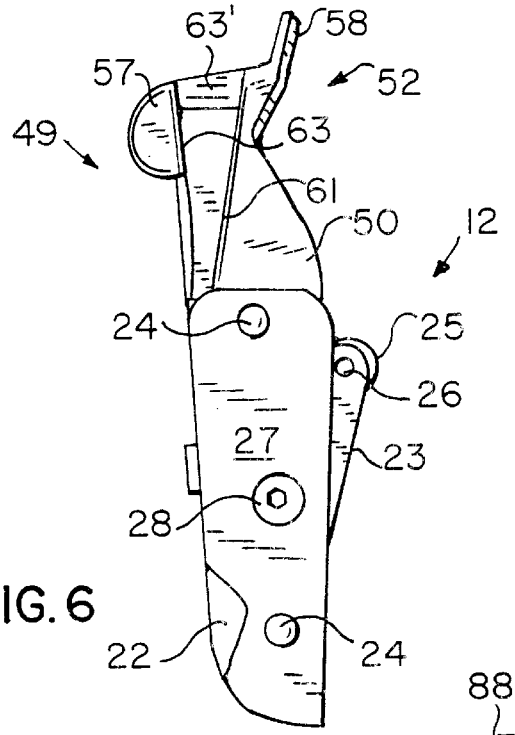
FIG. 6 is a side elevational view of the rearward securing assembly of FIG. 1 shown attached to the biasing assembly in accord with the present invention.
Figure 7:
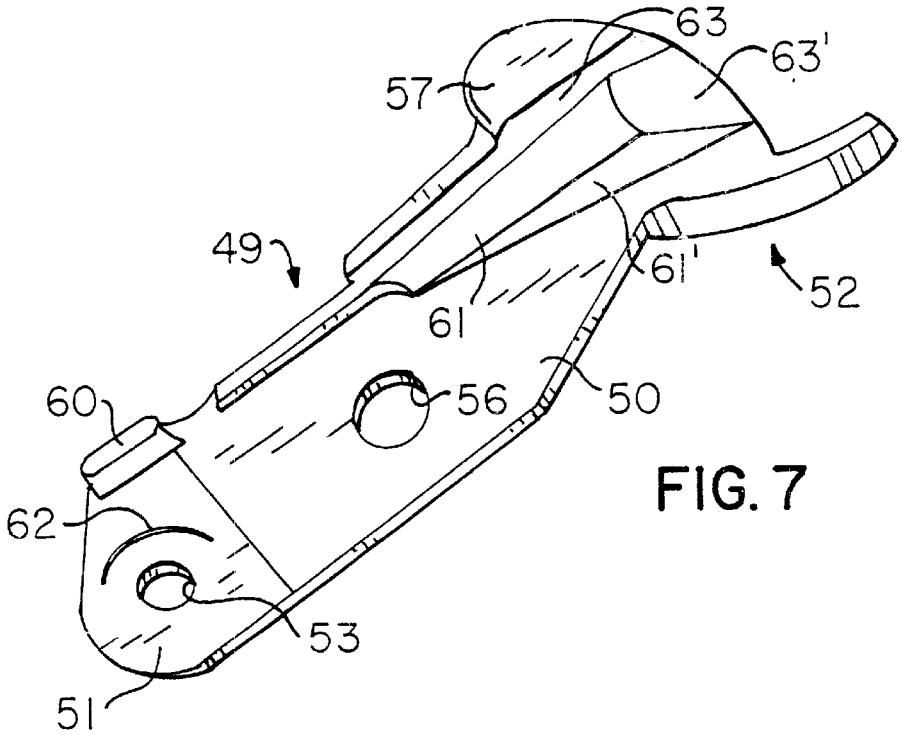
FIG. 7 is a perspective view of the blocking member employed in FIG. 6.
Figure 8:
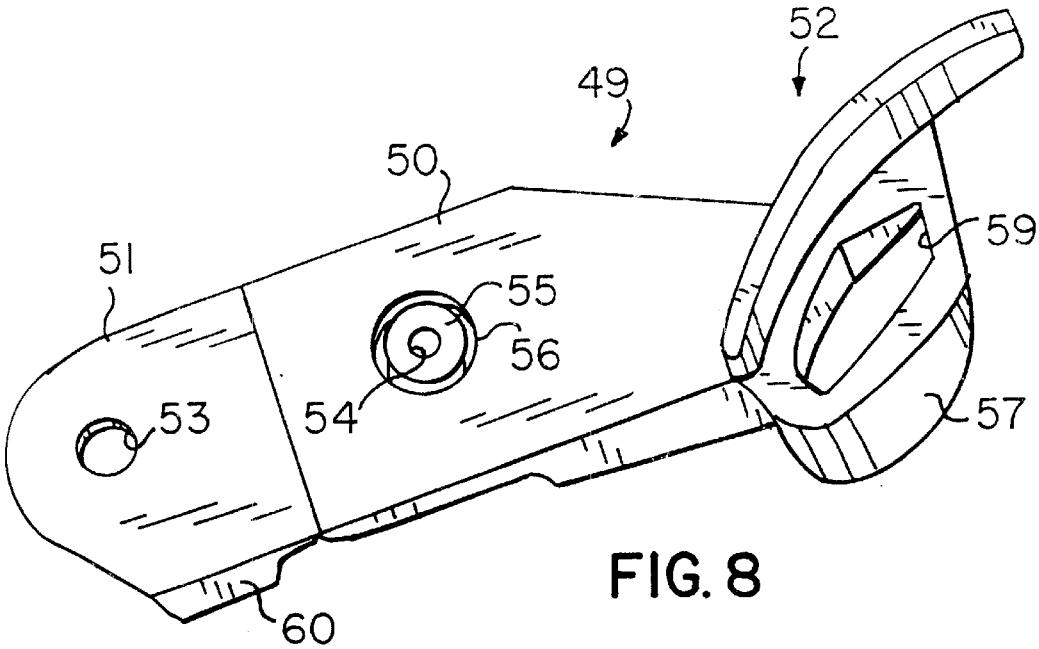
FIG. 8 is another perspective view of the blocking member of FIG. 7.

The blocking element is shown in FIGS. 6–8. Element 49 includes a body 50 having a first end portion 51 to which it is mounted to biasing member body 22 using pin 24 and a second end portion 52 including a finger ledge 57 by which it is moved sideways with a middle finger preferably, or an index finger.

First end portion 51 includes pin (or screw) hole 53 by which it is rigidly attached to body 22. Another medially located hole 56 in body 22 fits over laterally extending post 55 mounted on body 27. Hole 54 provides a passageway for a screw or bolt 45 mounting biasing assembly 12. Flange 58 extends laterally and aids in blocking debris from entering the holster 11 and the associated securing apparatus such as the pivot means. Cavity 59 in ledge 57 reduces weight. Rib sections 60 and 62 cooperate with the specific embodiment of biasing apparatus 12 used in the holster 11. Rib 61 is preferably in contact with trigger guard 17. The rib 61 is upraised to fit forwardly of ledge 57 against trigger guard 17 to minimize the allowed rearward movement of handgun 16 before the movement is blocked. When blocking element 49 is moved sideways by finger pressure on ledge 57, rib 61 is moved away from trigger guard 17 and sufficient room will exist between adjacent flange 63 and surface 63' to allow enough to allow enough rearward movement of the handgun 16 to disengage the ejection port 19 from stop means boss 40 but not enough movement to allow the gun 16 to clear the rotating hood 29 if the hood 29 is upward in its blocking position.

FIG. 3 illustrates an alternative embodiment of a rearward securing assembly 67. Biasing assembly 68 is substantially the same as the assembly 12. Housing 69 provides space 70 for spring 71 and guard block 72 that is normally biased to be in contact with trigger guard 17. Vertical channel 73 is also formed in housing 69 and provides a travel path for holding pin 74 by which block 72 is mounted to spring 71. Trigger guard arm 75 extends upward on the inward (user's) side of holster 76 and terminates in thumb ledge 77. Downward pressure on ledge 77 pushes guard block 72 downwardly in space 70 below trigger guard 17 allowing for rearward motion of gun 16 as before. Spring 71 mounted being locating elements 78 and 79.

Figure 10:
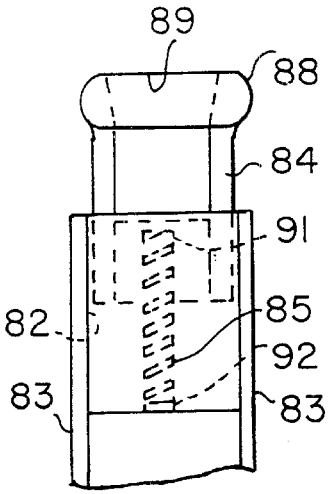
FIG. 10 is a rear view of the guard block of FIG. 9.
Figure 9:
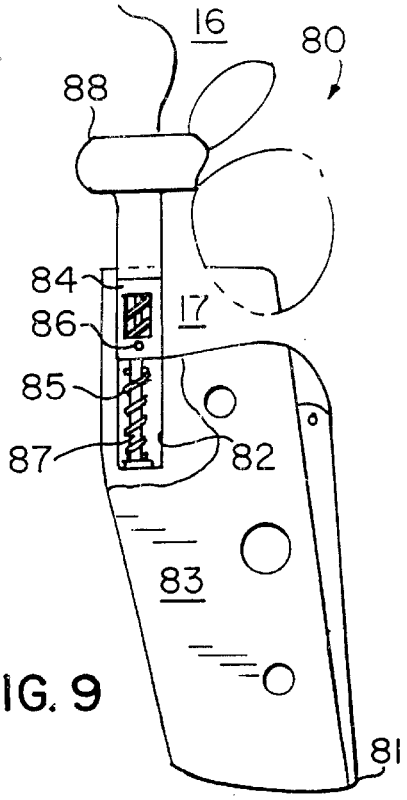
FIG. 9 is a side elevational view of another embodiment of the rearward securing assembly in accord with the present invention.

FIGS. 9 and 10 illustrate another embodiment of a rearward securing assembly 80. Biasing assembly 81 is substantially as before and includes a space 82 in housing 83 in which guard block 84 is mounted on spring 85 via pin 86 which moves in vertical channel 87. Finger ledge 88 is used to depress block 84 downwardly to allow rearward movement of trigger guard 17 for withdrawal of gun 16 as before.

Finger ledge 88 is formed with a medially located channel 89 to keep ledge 88 close to the gun 16 for close to the handgun 16 for increased safety spring locating elements 91, 92 are as before.

To summarize, when handgun 16 is inserted into the holster 1 the tapered portion of stop 15 results in an angled entry of the muzzle with the trigger guard 17 rearwardly. As the handgun 16 is inserted further, biasing means 12 begins to force handgun 16 forwardly as trigger guard 17 makes contact with rear securing means 14 at a rearward portion of cam or flange surface 63' and the trigger guard pushes the blocking element 49 inwardly out of the way to permit handgun 16 to become fully seated, whereupon the blocking element 49 by surface 61' of rib 61 engages the trigger guard 17 to prevent rearward movement and to automatically lock the gun in the holster. Further securing is accomplished by rotating hood 29 over the handgun 16 and further securing by hand lock-blocking element 34.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by letters patent of the united states is:

1. An automatic locking holster comprising a quick release withdrawal restraint, an inner and outer sidewall joined together along front and back portions to define an inner cavity with an interior channel formed along a forward portion of said inner cavity and having an open top shaped to fit a handgun holstered therein, said restraint including mechanical means located in and maintained by said interior channel to engage a portion of a handgun in said holster to inhibit withdrawal of a handgun upwardly prior to rearward movement of a handgun, blocking means including a body member mounted in and adjacent a rearward portion of said inner cavity and biased in a first position that engages a portion of a handgun to inhibit rearward movement of a handgun until said body member is selectively moved, said body member having a second position that permits rearward movement of a handgun to withdraw same from said holster.

2. The holster as defined in claim 1 wherein said mechanical means includes stop means having a readily replaceable element unattached to said holster and means to retain said element to said holster in a fixed position.

3. The holster as defined in claim 1 wherein said mechanical means includes inwardly disposed stop means having a boss with a front end portion and a rear end portion, said front end portion of said boss being shaped to engage an ejection port of a handgun to inhibit upward movement of a handgun.

4. The holster as defined in claim 3 wherein said rear portion of said boss is tapered to allow a muzzle of a handgun to slide therealong without contact with said stop means during insertion of a handgun into said holster until a handgun is fully seated in said holster.

5. The holster as defined in claim 3 further including biasing means mounted inside said cavity of said holster for forcing a handgun forwardly in said holster for engagement of a handgun with said stop means.

6. The holster as defined in claim 5 wherein said biasing means includes a housing affixed to said holster, said blocking means includes a body member and attaching means for mounting said body member to said housing of said biasing means.

7. The holster as defined in claim 6 wherein said housing includes a laterally projecting post member, said body member of said blocking means having an opening formed therein to fit said post member therein when said blocking means is in said first position to inhibit rotative movement of said body member, said post member being at least partially removed from said opening when said body member is in said second position.

8. The holster as defined in claim 1 wherein said blocking means further includes attaching means for mounting said body member to said holster for movement of said body member between said first and second positions.

9. The holster as defined in claim 8 wherein said body member includes a laterally extending flange member shielding an upper edge of said inner cavity to inhibit entry of debris into said cavity which otherwise may foul movement of said body member.

10. The holster as defined in claim 8 wherein said body member includes a finger ledge for selectively moving said body member with respect to attaching said means with a force applied by a finger of a user.

11. The holster as defined in claim 10 wherein said body member is movable out of engagement with a trigger guard of a handgun when force is applied by a middle finger of a user to said finger ledge.

12. The holster as defined in claim 11 wherein said body member is movable inwardly toward a user by force applied to said finger ledge by a middle finger of a user.

13. The holster as defined in claim 11 wherein said body member is movable downwardly by force applied to said ledge by a finger of a user.

14. An automatic locking holster comprising a quick release withdrawal restraint, an inner and outer sidewall joined together along front and back portions to define an inner cavity with an interior channel formed along a forward portion of said inner cavity and having an open top shaped to fit a handgun holster therein, said restraint including stop means located in and maintained by said interior channel to engage a portion of a handgun in the holster to inhibit withdrawal of a handgun upwardly prior to rearward movement of a handgun, blocking means including a body member mounted in and adjacent a rearward portion of said inner cavity and biased in a first position that engages a portion of a handgun to inhibit rearward movement of a handgun until said body member is selectively moved, said body member having a second position that permits rearward movement of a handgun to withdraw same from said holster.

15. The holster as defined in claim 14 further including and elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment including a detent means releasably engaged with said means for pivotal attachment for preventing forward pivotal movement of said restraining strap until said strap is moved at said means for pivotal attachment in a predetermined direction.

16. The holster as defined in claim 15 further including selectively operable blocking means attached to said holster movable between a first position to prevent forward pivotal movement of said strap after said strap has first been moved in said downward direction and a second position to allow forward pivotal movement of said strap after said strap has been moved in said downward direction.

17. The holster as defined in claim 14 further including biasing means mounted inside said cavity of said holster for forcing a handgun forwardly in said holster for engagement of a handgun with said stop means.

18. The holster as defined in claim 17 wherein said biasing means includes a housing affixed to said holster, said blocking means includes a body member and attaching means for mounting said body member to said housing of said biasing means.

19. The holster as defined in claim 18 wherein said housing includes a laterally projecting post member, said body member of said blocking means having an opening formed therein to fit said post member therein when said blocking means is in said first position to inhibit rotative movement of said body member, said post member being at least partially removed from said opening when said body member is in said second position.

20. The holster as defined in claim 14 wherein said blocking means further includes attaching means for mounting said body member to said holster for movement of said body member between said first and second positions.

21. The holster as defined in claim 20 wherein said body member includes a finger ledge for selectively moving said body member with regard to said attaching means with a force applied by the finger of a user.

22. The holster as defined in claim 20 wherein said body member includes a laterally extending flange member shielding an upper edge of said inner cavity to inhibit entry of debris into said cavity which otherwise may foul movement of said body member.

23. The holster as defined in claim 14 wherein said stop means includes a readily replaceable element unattached to said holster and means to retain said element to said holster in a fixed position.

24. The holster as defined in claim 23 further including biasing means mounted inside said cavity of said holster for forcing a handgun forwardly in said holster for engagement of a handgun with said stop means.

25. The holster as defined in claim 23 wherein said stop means includes an inwardly disposed boss having a front end portion and a rear end portion, said front end portion of said boss being shaped to engage an inner surface of an ejection port of a handgun to inhibit upward movement of a handgun.

26. The holster as defined in claim 25 wherein said rear portion of said boss is tapered to allow a muzzle of a handgun to slide therealong without contact with said stop means during insertion of a handgun into said holster until a handgun is fully seated in said holster.

27. An automatic locking holster comprising a quick release withdrawal restraint, an inner and outer sidewall joined together along front and back portions to defined an inner cavity and an interior channel formed along a forward portion of said inner cavity and having an open top shaped to fit a handgun holstered therein, said restraint including mechanical means located in and maintained by said interior channel to engage a portion of a handgun in the holster to inhibit withdrawal of a handgun upwardly prior to rearward movement of a handgun, blocking means including a body member mounted in and adjacent a rearward portion of said inner cavity and biased in a first position that engages a portion of a handgun to inhibit rearward movement of a handgun until said body member is selectively moved, said body member having a second position that permits rearward movement of a handgun to withdraw same from said holster.

28. The holster as defined in claim 27 wherein said biasing means includes a housing affixed to said holster, said blocking means includes a body member and attaching means for mounting said body member to said housing of said biasing means.

29. The handgun as defined in claim 27 wherein said body member includes a finger ledge for selectively moving said body member with regard to said attaching means with a force applied by the finger of a user.

30. The holster as defined in claim 27 wherein said mechanical means includes stop means having an inwardly disposed boss for engagement with an ejection port of a handgun to inhibit upward movement of a handgun.

31. The holster as defined in claim 27 further including a vertically disposed arm member having a lower portion attached to said body member of said blocking means, said arm member having an upper portion formed as a thumb ledge for applying downward force to said body member for moving said body member to said second position.

* * * * *